US006241854B1

(12) United States Patent
Frawley, Jr.

(10) Patent No.: US 6,241,854 B1
(45) Date of Patent: Jun. 5, 2001

(54) SUCTION ROLL SEALING STRIP

(75) Inventor: Thomas Edward Frawley, Jr., Appleton, WI (US)

(73) Assignee: Appleton International, Inc., Kimberly, WI (US)

( * ) Notice: Subject to any disclaimer, the term of this patent is extended or adjusted under 35 U.S.C. 154(b) by 0 days.

(21) Appl. No.: 09/258,944

(22) Filed: Mar. 1, 1999

Related U.S. Application Data

(63) Continuation-in-part of application No. 08/856,540, filed on May 15, 1997, now Pat. No. 5,876,566.

(51) Int. Cl.[7] ..... D21F 3/10

(52) U.S. Cl. ..... 162/371; 162/374; 277/407; 277/944; 277/946

(58) Field of Search ..... 162/374, 369, 162/371, 363; 277/407, 938, 944, 946

(56) References Cited

U.S. PATENT DOCUMENTS

| | | | |
|---|---|---|---|
| 2,578,551 | 12/1951 | Hornbostel . | |
| 4,714,523 | 12/1987 | Sawyer, Jr. et al. | 162/371 |
| 4,915,787 | 4/1990 | Branyon et al. | 162/199 |
| 5,515,619 | 5/1996 | Kahl et al. | 34/114 |
| 5,580,424 | 12/1996 | Snellman | 162/371 |
| 5,876,566 | 3/1999 | Frawley, Jr. | 162/374 |

*Primary Examiner*—Dean T. Nguyen
(74) *Attorney, Agent, or Firm*—Whyte Hirschboeck Dudek SC

(57) ABSTRACT

A composite is provided for forming a sealing strip for use in a suction roll of a papermaking machine or other device for maintaining a seal when brought into contact with a surface and that has extended usability and wear. The composite is a blend of a nitrile rubber, graphite, carbon black, and at least one of a silicone oil or polytetrafluoroethylene as a lubricating agent, optionally with a phenolic resin. The sealing strip has silicone oil and/or polytetrafluoroethylene evenly distributed over the contact surface, and when installed into a suction roll or other device, provides a reduced frictional surface.

32 Claims, 2 Drawing Sheets

SUCTION ROLL SEALING STRIP

CROSS-REFERENCE TO RELATED APPLICATIONS

This application is a continuation-in-part of U.S. Pat. application Ser. No. 08/856,540, filed May 15, 1997 now U.S. Pat. No. 5,876,566.

FIELD OF THE INVENTION

The present invention relates to a composite for forming a sealing strip for use in a suction roll of a papermaking machine.

BACKGROUND OF THE INVENTION

In a continuous papermaking machine such as a Fourdrinier machine, paper sheets are formed by passing a fiber and water slurry from a headbox onto a mesh screen and draining off the water to form a sheet of paper fiber. The sheet is then moved through a press section with rollers that expresses the water, and a dryer section to reduce the moisture content from about 60% to about 5%. The dried sheet is then fed to a high-speed calendar for compaction and finishing.

The drying section is typically composed of a series of revolving suction rolls. A screen belt that supports the paper sheet passes over the suction rolls at high speed. A suction roll is generally composed of a stationary vacuum box that is centrally disposed inside a perforated cylinder or shell. The vacuum box has a slot opening and a sealing strip on either side of the opening. The sealing strips are pressed against the inner surface of the perforated shell to form a seal so that, as the perforated shell rotates about the vacuum box, water from the paper sheet is drawn through the holes of the shell and the slot opening into the vacuum box. Due to the continuous abrasive contact with the inside surface of the rotating shell, the sealing strips become worn out after a relatively short time and must be replaced, which requires a complete shutdown of the machinery.

Attempts have been made to develop sealing strips having increased durability and a longer life. U.S. Pat. No. 4,714,523 (Sawyer) discloses a sealing strip made of a wear-resistant material with a narrow inlay strip of polytetrafluoroethylene (PTFE; Teflon™) that is exposed along the surface of the edge of the sealing strip. The PTFE strip rubs against the inside surface of the shell to lubricate the interface of the two elements and reduce friction. Although useful, a drawback of this sealing strip is that the PTFE insert strip can wear down to below the contact surface such that the PTFE insert is no longer effective in contacting and lubricating the shell surface. Another drawback is that the sealing strip requires an initial time interim for the PTFE to become distributed over the surface to provide a level of lubrication that allows a smooth interaction between the rotating shell and the sealing strips.

Therefore, an object of the invention is to provide a composite for forming a sealing strip for mounting in a suction roll of a papermaking machine that is highly durable and has increased compatibility and reduced abrasion against the inside surface of the perforated cylinder of a suction roll. Another object is to provide a sealing strip that will provide a high level of lubrication substantially immediately upon use and throughout the life of the sealing strip.

SUMMARY OF THE INVENTION

These and other objects are achieved by the present invention which is directed to a composite for forming a sealing strip for use in a suction roll of a papermaking machine that has extended usability and wear, and a low coefficient of friction. Also provided is a sealing strip formed from the composite that can be used to seal a juncture between a vacuum box and a perforated cylindrical shell of a suction roll. Further provided are methods of making the composite and the sealing strip.

The composite is a blend of a nitrite rubber, graphite, and carbon black with silicone oil and/or polytetrafluoroethylene (PTFE, e.g., Teflon™) dispersed throughout, and optional additives and processing aids as desired. Optionally, but preferably, the composite can include a phenolic resin for increased hardness and flexural properties. The ingredients are compounded together and can be processed into a sealing strip, for example, by extrusion or compression molding. The composite includes an effective amount of silicone oil and/or polytetrafluoroethylene ranging from a trace amount to about 30 wt-% to provide a sealing strip that has the silicone oil and/or polytetrafluoroethylene distributed throughout the contact surface, and a low frictional coefficient of about 0.02–0.06.

Advantageously, a sealing strip formed from the composite has reduced coefficient of friction substantially immediately upon use which increases the life of both the sealing strip and the perforated shell as compared to conventional sealing strips. Use of the present sealing strips in a suction roll will also reduce the amount of heat that is generated from the contact of the sealing strip with the shell surface.

BRIEF DESCRIPTION OF THE DRAWINGS

Throughout the following views, reference numerals will be used in the drawings, and like reference numerals will be used throughout the several views and in the description to indicate corresponding parts of the invention.

DETAILED DESCRIPTION OF THE INVENTION

The present invention provides a composite for forming a sealing strip for use in a suction roll assembly of a papermaking machine. The amounts of ingredients are given in parts based on 100 parts of the nitrile rubber, and in wt-% amounts based on the entire composition.

Figure 1:
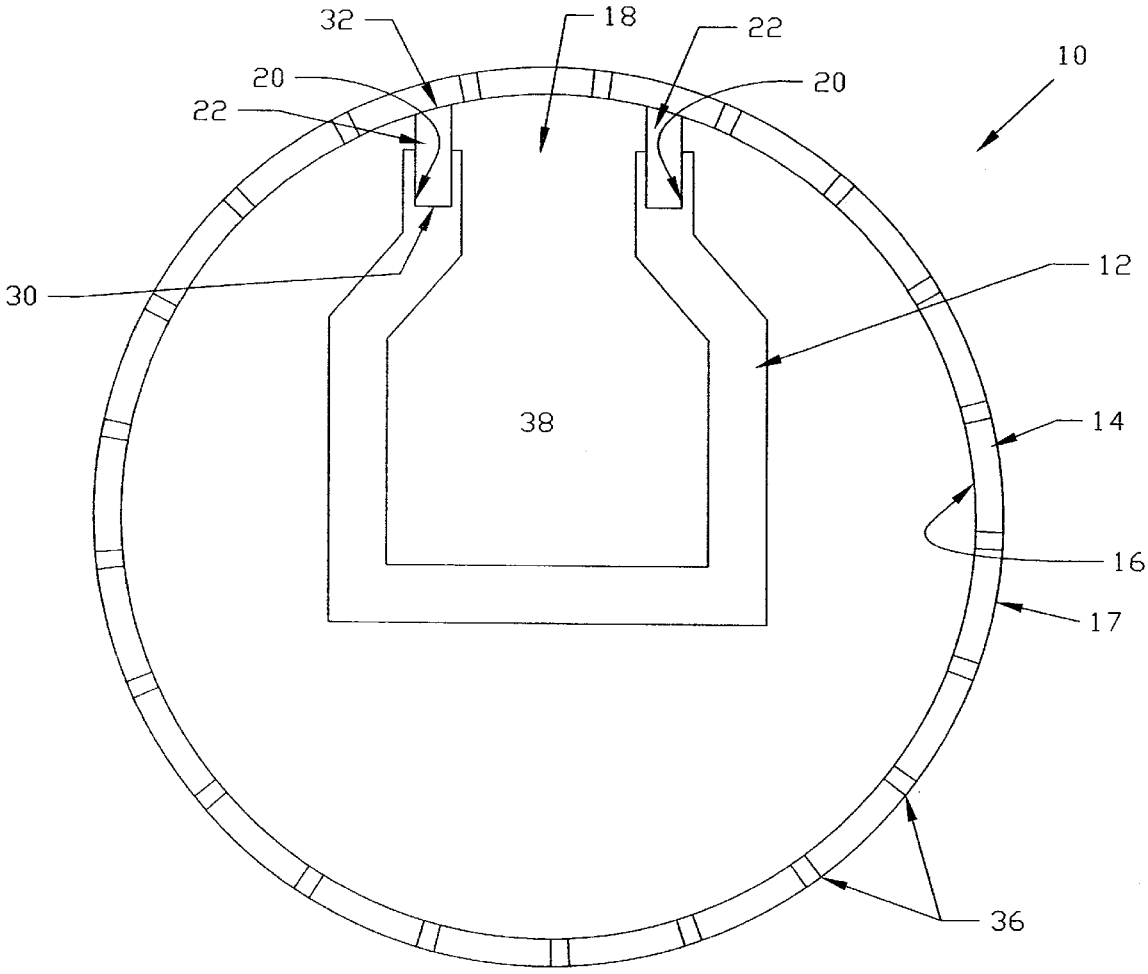
FIG. 1 is a sectional view of a sealing strip in association with a prior art suction roll assembly of a papermaking machine.

Referring now to the drawings, FIG. 1 depicts a prior art suction roll assembly, designated generally by reference numeral 10, of a papermaking machine such as a Fourdrinier machine for forming paper from a pulp slurry. The suction roll assembly 10 is composed of a stationary vacuum box 12 centrally disposed within a perforated cylindrical shell 14 that, in use, rotates about the vacuum box 12. The cylindrical shell 14 has an inside surface 16 and an outside surface 17, and is typically fabricated from bronze, stainless steel or other like material. The vacuum box 12 has a slot opening 18 and two U-shaped slots 20 that extend the width 21 of the vacuum box 12 along the opening 18 and are each sized to receive a sealing strip 22 therein.

Figure 2:
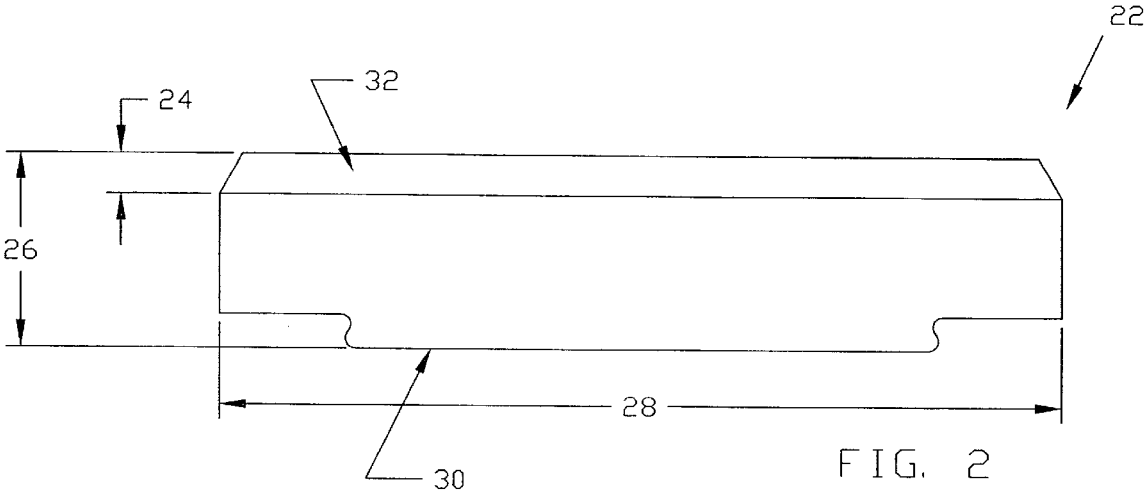
FIG. 2 is a front view of a sealing strip for use in the suction roll assembly of FIG. 1.

An example of a sealing strip 22 is shown in FIG. 2. The sealing strip 22 is generally an elongate rectangular block with a width 24, height 26 and length 28, and an opposing base edge 30 and contact edge 32. A typical sealing strip is about ¾" wide and about 2" high, with a length 28 that corresponds to the width of the U-shaped slot 20 of the vacuum box 12. The sealing strip 22 can be formed from a plurality of intermitting pieces (not shown). The sealing strip 22 is sized to fit into the U-shaped slot 20 with the contact edge 32 of the sealing strip 22 extending outward from the slot 20 so as to engage the inside surface 16 of the cylindrical shell 14 when the vacuum box 12 is disposed within the shell 14. The contact edge 32 of the sealing strip 22 will form and maintain a seal against the inside surface 16 of the cylindrical shell 14 to cause fluid from a paper slurry (not shown) passing along the outside surface 17 of the cylindrical shell 14 to be drawn through the perforations 36 and the slot opening 18 into the interior portion 38 of the vacuum box 12.

According to the present invention, the composite for forming a sealing strip 22 is composed of an acrylonitrile rubber, graphite, carbon black, and a lubricating agent that are blended and compounded together. A sealing strip formed from the composite will have the lubricating agent dispersed throughout the contact edge 32 and the body of the strip. The sealing strip 22 is highly durable and, when installed into a suction roll assembly (or other device), will maintain an effective seal with the shell 14 and provide a low abrasion resistance and frictional contact with the inside surface 16 of the shell 14.

The base material of the composite is an acrylonitrile rubber (nitrile-butadiene rubber, NBR). A preferred nitrile rubber for the composite is Hycar® 1052, and the like, available commercially from Goodyear. The composition can include about 10–25 wt-% nitrile rubber, preferably about 15–20 wt-%.

Carbon black is included as a reinforcing agent to provide abrasion resistance, tear resistance and tensile strength. Based on about 100 parts of the nitrile rubber base material, the composition can include about 50–100 parts carbon black, preferably about 55–65 parts, or about 5–15 wt-%.

The composite includes graphite for structure and as a lubricating agent. The composite is composed of about 25–45 wt-% graphite, preferably about 3040 wt-%, or about 150–200 parts graphite, preferably about 175–185 parts, based on 100 parts nitrile rubber.

The composite further includes an effective amount of silicone oil, polytetrafluoroethylene (PTFE), or a mixture thereof, as a lubricating agent to provide a low coefficient of friction between the contact edge 32 of the sealing strip 22 and the inside surface 16 of the cylindrical shell 14. The composite prepared with polytetrafluoroethylene (PTFE) alone as the lubricating agent, can include about 0.1–30 wt-%, preferably about 1–30 wt-%, preferably 5–25 wt-%, preferably 10–20 wt-%. Based on 100 parts of the nitrile rubber base material, the composition can include about 5–80 parts, preferably 10–75 parts, preferably 50–70 parts. Polytetrafluorethylene is available commercially under the tradenames Teflon™ (DuPont) and Halon™ (Allied-Signal), and preferably is used in powder form.

It was found that a fluid silicone such as polymethylsiloxane (PDMS), and dimethylpolysiloxane as the lubricating agent, used alone or combined with PTFE, substantially decreased the abrasiveness of a sealing strip against a surface compared to a sealing strip made with a composite containing PTFE (teflon) alone as the lubricating agent. The composite can be formulated with about 0.1–10 wt-% silicone oil alone, preferably about 1–10 wt-%, preferably about 1–5 wt-%, or about 1–20 parts, preferably about 5–20 parts, preferably about 5–10 parts, based on 100 parts of the nitrile rubber base material.

When PTFE and silicone oil are used in combination as the lubricating agent, it is preferred that the composite is formulated with about 1–10 wt-% silicone oil, preferably about 1–5 wt-%, and about 1–30 wt-% PTFE, preferably about 5–25 wt-%, preferably about 10–20 wt-%. Based on 100 parts nitrile rubber, the composition can include the silicone oil at about 1–20 parts, preferably about 5–20 parts, preferably about 5–10 parts, and the PTFE at about 5–80 parts, preferably about 10–75 parts, preferably about 50–70 parts.

The composite can further include about 1–10 wt-% of a vulcanizing agent (e.g., sulfur), or about 20–30 parts based on 100 parts of the nitrile rubber component. The composition can also include an accelerating agent, as for example, N-cyclohexylbenzothiazyl sulphenamide (e.g., Santocure MORN, Monsanto) or other thiazole accelerator, preferably at about 0.05–0.15 wt-%, or about 0.8–1.2 parts/100 parts nitrite rubber.

It is preferred that the composition is formulated with an effective amount of a phenolic resin to enhance surface hardness and increase flexural properties. An example of a useful phenolic resin is Akrochem® P86 (Akrochem Company, Akron, Ohio), and the like. The composition can include about 10–20 wt-% phenolic resin, or about 25–100 parts, preferably about 70–80 parts, based on about 100 parts of the nitrite rubber base material. About 1–2 wt-% of a crosslinking/curing agent is preferably included with the phenolic resin, as for example, hexamethylenetetramine (HEXA).

The composite can further include minor but effective amounts of optional additives and processing aids as desired. Such optional ingredients include, for example, a stabilizing agent such as stearic acid or other organic acid at about 0.2–1 wt-% (about 14 parts per 100 parts nitrite rubber); a dehydrating agent such as calcium oxide (e.g., Desical™) at about 1–5 wt-% (about 5–10 parts); and processing aids to decrease the viscosity and improve workability, flow and adherence. Useful processing aids include, for example, a metallic oxide (e.g., zinc oxide) at about 0.5–1.5 wt-% (about 3–8 parts/$1^{00}$ parts nitrite rubber); a softener/tackifier, as for example, a coumarine-indene resin (e.g., Cumar™ from Neville) at about 1–2 wt-% (about 5 –10 parts/100 parts nitrile rubber); and a plasticizer/dispersing agent (e.g., Sruktol®WB 222, Struktol Company of America, Stow, Ohio) at about 0.2–1 wt-% (about 14 parts per 100 parts nitrile rubber). The composite can also include an effective amount of an antioxidant to improve resistance to deterioration.

The composite ingredients are blended together by common rubber compounding methods using a roll mill and/or internal mixer (e.g., Banbury mixer) to achieve a substantially uniform blend of the constituents. The composite can be extruded into a bar form for finish machining or compression molded into a rectangular block, and processed by vulcanization, all according to standard techniques known and used in the art. The dimensions of a typical sealing strip are about ¾" in width (w) by about 2" in height (h) with a length (l) 28 that will vary according to the width of the vacuum box 12.

As the cylindrical shell 14 rotates against the sealing strip 22, the contact surface 32 of the sealing strip 22 wears down gradually due to the continuous contact with the inside surface 16 of the shell 14, and the lubricating agent (silicone oil and/or polytetrafluoroethylene (PTFE)) is substantially evenly coated over the surface of the contact edge 32. The contact edge 32 of the sealing strip 22 rubs against the inside surface 16 of the shell 14 which causes the silicone oil and/or PTFE lubricating agent to become smeared onto the inside surface 16, thus lubricating and reducing the friction between the two members.

Figure 3:
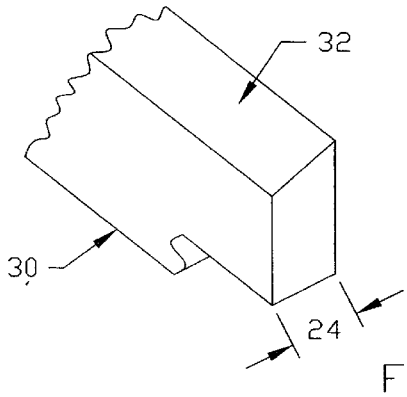
FIG. 3 is a partial perspective view of the sealing strip of FIG. 2.
Figure 4:
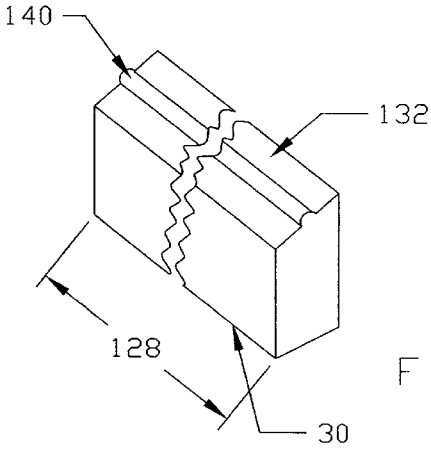
FIG. 4 is a partial perspective view of a second embodiment of a sealing strip.

The contact edge 32 of the sealing strip 22 can be substantially linear and smooth as shown in FIG. 2, or can include a protrusion 140 extending the length 128 of the sealing strip 122 as shown in FIG. 3. The protrusion 140 advantageously provides a smaller surface area to quickly conform to irregularities that may be present in the inside surface 16 of the shell 14.

The advantage of a sealing strip formulated from the present composite with silicone oil or silicone oil/PTFE (and to a lesser extent PTFE alone) distributed throughout the contact edge 32, as compared to a sealing strip having a strip inlay of PTFE such as provided by Sawyer (U.S. Pat. No. 4,714,523) is that the present sealing strip is less abrasive and more compatible with the shell of the suction roll, and provides a suitable level of lubrication substantially immediately upon use. Sealing strips made from the present composite advantageously are longer lasting and provide a lower coefficient of friction against the inside surface 16 of the cylindrical shell 14 compared to other conventional composite sealing strips that do not have the silicone oil and/or PTFE distributed throughout. In addition, the silicone oil and/or PTFE lubricating agent remains evenly distributed and available for lubricating the surface 16 of the shell 14 for the life of the sealing strip, whereas an inlay strip of PTFE is only effective for lubrication while the PTFE strip itself is in contact with the shell surface.

The invention will be further described by reference to the following detailed example. This example is not meant to limit the scope of the invention that has been set forth in the foregoing description. It should be understood that many variations and modifications may be made while remaining within the spirit and scope of the invention. The invention is not to be construed as limited to the specific embodiments shown in the drawings. The disclosures of the cited references are incorporated by reference herein.

EXAMPLE 1

Sealing Strip Composite with Polytetrafluoroethylene as Lubricating Agent

Nitrile Rubber, graphite and carbon black were blended together with processing aids according to the below-listed formulation. A phenolic resin (e.g., Akrochem® P86; Akrochem Company, Akron, Ohio) was added to enhance the flexural properties and surface hardness of the formed sealing strip. The Teflon™ polytetrafluoroethylene (PTFE) component was added to the mixture in fine powder form for even dispersion.

| Ingredient | Parts |
|---|---|
| Hycar ™ nitrile rubber | 100.00 |
| Teflon ™ PTFE | 60.00 |
| Graphite | 180.00 |
| Carbon black | 60.00 |
| Zinc oxide | 5.00 |
| Stearic acid | 2.00 |
| Age Rite ™ resin | 2.00 |

-continued

| Ingredient | Parts |
|---|---|
| Struktol ® WB 222 plasticizer/dispersant | 2.00 |
| HEXA (curing agent) | 9.00 |
| Sulfur | 25.00 |
| Santocure MOR ™ accelerator | 1.00 |
| Akrochem ® P86 phenolic resin | 75.00 |
| Cumar ™ resin | 8.00 |
| Desical ™ desiccant | 7.00 |

The components were blended together using a Banbury mixer, and then extruded into a bar form and machine finished. The finished sealing strip had the PTFE component evenly dispersed throughout. Because of the nature of PTFE, as the material wears, the PTFE levels out on the contact surface of the sealing strip and provides a reduced friction surface against the inside of the perforated cylindrical shell of the suction roll. This reduces shell wear and heat while improving the abrasion resistance of the seals.

EXAMPLE 2

Sealing Strip Composite with Silicone Oil as Lubricating Agent

The below listed components were blended together, extruded into a bar form, and machine finished to form a sealing strip with silicone oil dispersed throughout.

| Ingredient | Parts |
|---|---|
| Nitrile rubber | 100 |
| Silicone Oil | 10 |
| Graphite | 200 |
| Carbon black | 100 |

EXAMPLE 3

Sealing Strip Composite with PTFE and Silicone Oil

The components below were combined and extruded to form a bar that was machine finished to form a sealing strip with both silicone oil and teflon distributed throughout the strip.

| Ingredient | Parts |
|---|---|
| Nitrile rubber | 100 |
| Silicone Oil | 10 |
| Teflon ™ PTFE | 75 |
| Graphite | 200 |
| Carbon black | 100 |

What is claimed:

1. In a papermaking machine, a method of sealing a juncture between a vacuum box and a perforated cylindrical shell of a suction roll, the vacuum box being disposed within the perforated cylindrical shell that is rotatable around the vacuum box, the vacuum box having a width and a U-shaped slot extending the width, and the cylindrical shell having an inside surface, the method comprising:

(a) providing a composite sealing strip having a length, width and height, and opposing base and contact edges; the strip being sized to be disposed within the U-shaped slot with the length of the strip extending the width of the vacuum box; the contact edge having a surface adapted to engage the inside surface of the cylindrical shell to form a seal;

the entire contact edge surface of the sealing strip composed of a substantially uniform composite blend of effective amounts of about 10–25 wt-% nitrite rubber, about 25–45 wt-% graphite, about 5–15 wt % carbon black and a lubricating agent selected from the group consisting of about 0.1–10 wt-% silicone oil or a combination of about 1–10 wt-% silicone oil and about 1–30 wt-% polytetrafluoroethylene, in amounts effective to provide the contact edge of the sealing strip with a low coefficient of friction when placed into contact with the inside surface of the cylindrical shell and as the shell rotates against the contact edge of the sealing strip;

(b) inserting the sealing strip into the U-shaped slot of the vacuum box with the contact edge extending out of the slot; and (c) engaging the contact edge of the sealing strip against the inside surface of the cylindrical shell to form a seal effective to provide suction of a fluid through the perforations of the cylindrical shell into the vacuum box as the cylindrical shell rotates about the vacuum box;

wherein the contact edge of the sealing strip provides a low coefficient of friction of about 0.02–0.06 against the inside surface of the rotating cylindrical shell.

2. The method according to claim 1, wherein the processing step (ii) comprises extruding or compression molding the composite.

3. In a papermaking machine, a method of sealing a juncture between a vacuum box and a perforated cylindrical shell of a suction roll, the vacuum box being disposed within the perforated cylindrical shell that is rotatable around the vacuum box, the vacuum box having a width and a U-shaped slot extending the width, and the cylindrical shell having an inside surface, the method comprising:

(i) compounding together to form a composite blend of:
(a) about 100 parts nitrile rubber;
(b) about 50–100 parts carbon black;
(c) about 150–200 parts graphite; and
(d) about 1–20 parts silicone oil;

(ii) processing the composite blend into a sealing the strip having a length, width and height, and opposing base and a contact edge; the sealing strip being sized to be disposed within the U-shaped slot with the length of the sealing strip extending the width of the vacuum box; the contact edge having a surface adapted to engage the inside surface of the cylindrical shell to form a seal;

the sealing strip composed of the composite blend to provide the contact edge of the sealing strip with a low coefficient of friction when placed into contact with the inside surface of the cylindrical shell and as the shell rotates against the contact edge of the sealing strip;

(iii) inserting the sealing strip into the U-shaped slot of the vacuum box with the contact edge extending out of the slot; and (iv) engaging the contact edge of the sealing strip against the inside surface of the cylindrical shell to form a seal effective to provide suction of a fluid through the perforations of the cylindrical shell into the vacuum box as the cylindrical shell rotates about the vacuum box;

wherein the contact edge of the sealing strip provides a low coefficient of friction of about 0.02–0.06 against the inside surface of the rotating cylindrical shell.

4. The method according to claim 3, wherein the composite blend further comprises about 10–75 parts polytetrafluoroethylene.

5. The method according to claim 4, wherein the composite blend further comprises about 70–80 parts phenolic resin.

6. A sealing strip for use in a vacuum box of a suction roll of a papermaking machine, the vacuum box being centrally disposed inside a rotatable perforated cylindrical shell of the suction roll; the sealing strip comprising:

a substantially uniform composite blend of about 10–25 wt-% nitrile rubber, about 25–45 wt-% graphite, about 5–15 wt-% carbon black, and about 0.1–10 wt % silicone oil; the sealing strip having a length, height, width, base edge and contact edge;

wherein the contact edge is composed entirely of the composite blend;

wherein when the sealing strip is disposed in the vacuum box and the contact edge engages the cylindrical shell, the contact edge maintains a seal effective to cause suction of a fluid through the perforations of the cylindrical shell into the vacuum box;

and the nitrile rubber, graphite, carbon black and silicone oil provide the sealing strip with a low coefficient of friction of about 0.02–0.06 as the contact edge moves along the inside surface of the rotating cylindrical shell.

7. The sealing strip according to claim 6, comprising about 1–10 wt-% silicone oil.

8. The sealing strip according to claim 7, wherein the composite blend further comprises about 1–30 wt-% polytetrafluoroethylene such that the combination of the silicone oil and the polytetrafluoroethylene provide the sealing strip with said coefficient of friction.

9. The sealing strip according to claim 8, comprising about 1–5 wt-% silicone oil and about 5–25 wt-% polytetrafluoroethylene.

10. The sealing strip according to claim 6, comprising about 1–5 wt-% silicone oil.

11. The sealing strip according to claim 6, wherein the contact edge comprises a protrusion along the length of the sealing strip.

12. A sealing strip for use in a vacuum box of a suction roll of a papermaking machine, the vacuum box being centrally disposed inside a rotatable perforated cylindrical shell of the suction roll; the sealing strip comprising:

a composite blend of about 10–25 wt-% nitrile rubber, about 25–45 wt-% graphite, about 5–15 wt-% carbon black, and about 0.1–10 wt-% silicone oil, the sealing strip having a length, height, width, base edge and contact edge, wherein when the sealing strip is disposed in the vacuum box and the contact edge engages the cylindrical shell, the contact edge maintains a seal effective to cause suction of a fluid through the perforations of the cylindrical shell into the vacuum box;

and the amounts of the nitrile rubber, graphite, carbon black, and silicone oil are effective to provide the sealing strip with a low coefficient of friction of about 0.02–0.06 as the contact edge moves along the inside surface of the rotating cylindrical shell.

13. A sealing strip comprising:

a composite blend of about 100 parts nitrile rubber, about 150–200 parts graphite, about 50–100 parts carbon black, and about 5–20 parts silicone oil; the sealing strip having a length, height, width, base edge and contact edge;

wherein when the sealing strip is disposed in the vacuum box and the contact edge engages the cylindrical shell, the contact edge maintains a seal effective to cause suction of a fluid through the perforations of the cylindrical shell into the vacuum box;

and the amounts of the nitrile rubber, graphite, carbon black and silicone oil are effective to provide the sealing strip with a low coefficient of friction of about 0.02–0.06 as the contact edge moves along the inside surface of the rotating cylindrical shell.

14. A sealing strip comprising:

a composite blend of about 100 parts nitrile rubber, about 150–200 parts graphite, about 50–100 parts carbon black, about 5–20 parts silicone oil, and about 5–80 parts of polytetrafluoroethylene; the sealing strip having a length, height, width, base edge and contact edge;

wherein when the sealing strip is disposed in the vacuum box and the contact edge engages the cylindrical shell, the contact edge maintains a seal effective to cause suction of a fluid through the perforations of the cylindrical shell into the vacuum box;

and the amounts of the nitrile rubber, graphite, carbon black, silicone oil and polytetrafluoroethylene are effective to provide the sealing strip with a low coefficient of friction of about 0.02–0.06 as the contact edge moves along the inside surface of the rotating cylindrical shell.

15. A sealing strip comprising:

a composite blend of about 100 parts nitrile rubber, about 150–200 parts graphite, about 50–100 parts carbon black, about 5–20 parts silicone oil, and about 70–80 parts of a phenolic resin; the sealing strip having a length, height, width, base edge and contact edge;

wherein when the sealing strip is disposed in the vacuum box and the contact edge engages the cylindrical shell, the contact edge maintains a seal effective to cause suction of a fluid through the perforations of the cylindrical shell into the vacuum box;

and the amounts of the nitrile rubber, graphite, carbon black, silicone oil and phenolic resin are effective to provide the sealing strip with a low coefficient of friction of about 0.02–0.06 as the contact edge moves along the inside surface of the rotating cylindrical shell.

16. A sealing strip for use in a vacuum box of a suction roll of a papermaking machine, the vacuum box being centrally disposed inside a rotatable perforated cylindrical shell of the suction roll; the sealing strip comprising:

a substantially uniform composite blend of 15–20 wt-% nitrile rubber, 30–40 wt-% graphite, 5–15 wt-% carbon black, and a lubricating agent selected from the group consisting of 0.1–10 wt-% silicone oil or a combination of 1–10 wt-% silicone oil and 1–30 wt-% polytetrafluoroethylene; the sealing strip having a length, height, width, base edge and contact edge;

wherein the contact edge is composed entirely of the composite blend;

wherein when the sealing strip is disposed in the vacuum box and the contact edge engages the cylindrical shell, the contact edge maintains a seal effective to cause suction of a fluid through the perforations of the cylindrical shell into the vacuum box;

and the amounts of the nitrile rubber, graphite, carbon black, and lubricating agent are effective to provide the sealing strip with a low coefficient of friction of about 0.02–0.06 as the contact edge moves along the inside surface of the rotating cylindrical shell.

17. The sealing strip according to claim 16, wherein the composite blend comprises about 1–5 wt-% silicone oil.

18. The sealing strip according to claim 16, wherein the composite blend comprises about 1–5 wt-% silicone oil.

19. The sealing strip according to claim 16, wherein the composite blend comprises about 1–5 wt-% silicone oil, and about 5–25 wt-% polytetrafluoroethylene.

20. The sealing strip according to claim 16, wherein the composite blend comprises about 1–5 wt-% silicone oil, and about 10–20 wt-% polytetrafluoroethylene.

21. A sealing strip for use in a vacuum box of a suction roll of a papermaking machine, the vacuum box being centrally disposed inside a rotatable perforated cylindrical shell of the suction roll, the sealing strip having an opposing base edge and a contact edge, and the shell having an inside surface; the sealing strip comprising a composite blend of:

(a) about 100 parts nitrile rubber;

(b) about 50–100 parts carbon black;

(c) about 150–200 parts graphite; and (d) about 1–20 parts silicone oil;

wherein when the sealing strip is disposed in the vacuum box and placed in contact with the inside surface of the cylindrical shell, the sealing strip forms a seal effective to cause suction of a fluid through the perforations of the cylindrical shell into the vacuum box, and the contact edge of the sealing strip provides a low coefficient of friction against the inside surface of the cylindrical shell as the shell rotates around the vacuum box.

22. The sealing strip according to claim 21, wherein the composite further comprises about 5–80 parts polytetrafluoroethylene.

23. The sealing strip according to claim 21, wherein the composite further comprises about 25–100 parts phenolic resin.

24. A sealing strip having a contact edge and being composed of a composite blend of 10–25 wt-% nitrile rubber, 25–45 wt-% graphite, 5–15 wt-% carbon black and a lubricating agent selected from the group consisting of 0.1–10 wt-% silicone oil or a combination of 1–10 wt-% silicone oil and 1–30 wt-% polytetrafluoroethylene, wherein when the contact edge of the sealing strip is brought into contact with a surface, the contact edge maintains a seal, the contact edge is composed entirely of the composite blend, and the amounts of the nitrile rubber, graphite, carbon black and lubricating agent are effective to provide a low coefficient of friction of about 0.02–0.06 as the contact edge is moved along said surface.

25. The sealing strip according to claim 24, wherein the composite blend comprises about 1–5 wt-% silicone oil, and about 5–25 wt-% polytetrafluoroethylene.

26. A sealing strip for use in a vacuum box of a suction roll of a papermaking machine, the vacuum box being centrally disposed inside a rotatable perforated cylindrical shell of the suction roll; the sealing strip having a length, height, width, base edge and contact edge, and comprising:

a substantially uniform composite blend of about 15–20 wt-% nitrile rubber, about 30–40 wt-% graphite, about 5–15-wt % carbon black, about 1–10 wt-% silicone oil and about 1–30 wt-% polytetrafluoroethylene to provide the sealing strip, when disposed in the vacuum box and the contact edge engages the cylindrical shell, with a low coefficient of friction of about 0.02–0.06 as the contact edge moves along the inside surface of the rotating cylindrical shell, and a contact edge that is composed entirely of the composite blend and that maintains a seal effective to cause suction of a fluid through the perforations of the cylindrical shell into the vacuum box.

27. The sealing strip according to claim 26, wherein there is about 1–15 wt-% silicone oil.

28. A suction roll of a papermaking machine, comprising:

a stationary vacuum box centrally disposed within a perforated cylindrical shell rotatable around the vacuum box; the vacuum box having a width and a U-shaped slot extending the width, and the cylindrical shell having an inside surface;

a composite sealing strip having a length, width and height, and opposing base and contact edges; the sealing strip disposed within the U-shaped slot and extending the width of the slot with the contact edge extending out of the slot; the contact edge having a surface adapted to engage the inside surface of the cylindrical shell to form a seal;

the sealing strip comprising a composite blend of about 15–20 wt-% nitrile rubber, about 25–45 wt-% graphite, about 5–15 wt-% carbon black, and about 0.1–10 wt-% silicone oil or a combination of about 1–10 wt-% silicone oil and about 1–30 wt-% polytetrafluoroethylene, which provides the contact edge of the sealing strip with a surface having a low coefficient of friction of about 0.02–0.06 as the contact edge moves along the inside surface of the rotating cylindrical shell, wherein the contact edge is composed entirely of the composite blend.

29. A suction roll of a papermaking machine, comprising:

a stationary vacuum box centrally disposed within a perforated cylindrical shell rotatable around the vacuum box; the vacuum box having a width and a U-shaped slot extending the width, and the cylindrical shell having an inside surface;

a composite sealing strip having a length, width and height, and opposing base and contact edges; the sealing strip disposed within the U-shaped slot and extending the width of the slot with the contact edge extending out of the slot; the contact edge having a surface adapted to engage the inside surface of the cylindrical shell to form a seal;

the sealing strip comprising a composite blend of about 10–25 wt-% nitrile rubber, about 25–45 wt-% graphite, about 5–15 wt-% carbon black, and about 0.1–10 wt-% silicone oil, or a combination of about 1–10 wt-% silicone oil and 1–30 wt-% polytetrafluoroethylene, which provides the contact edge of the sealing strip with a surface having a low coefficient of friction of about 0.02–0.06 as the contact edge moves along the inside surface of the rotating cylindrical shell.

30. The suction roll according to claim 29, wherein the composite blend comprises about 1–5 wt-% silicone oil, and about 5–25 wt-% polytetrafluoroethylene.

31. A suction roll for a papermaking machine, comprising:

a stationary vacuum box centrally disposed within a perforated cylindrical shell rotatable around the vacuum box, the vacuum box having a width and a U-shaped slot extending the width, and the cylindrical shell having an inside surface;

a composite sealing strip having a length, width and height, and opposing base and contact edges; the sealing strip disposed within the U-shaped slot and extending the width of the slot with the contact edge extending out of the slot; the contact edge having a surface adapted to engage the inside surface of the cylindrical shell to form a seal;

the sealing strip comprising a composite blend of about 100 parts nitrile rubber, about 50–100 parts carbon black, about 150–200 parts graphite, and about 1–20 parts silicone oil or a combination of about 1–20 parts silicone oil and about 5–80 parts polytetrafluoroethylene, which provides the contact edge of the sealing strip with a surface having a low coefficient of friction of about 0.02–0.06 as the contact edge moves along the inside surface of the rotating cylindrical shell.

32. A suction roll of a papermaking machine, comprising:

a stationary vacuum box centrally disposed within a perforated cylindrical shell rotatable around the vacuum box; the vacuum box having a width and a U-shaped slot extending the width, and the cylindrical shell having an inside surface;

a composite sealing strip having a length, width and height, and opposing base and contact edges; the sealing strip disposed within the U-shaped slot and extending the width of the slot with the contact edge extending out of the slot; the contact edge having a surface adapted to engage the inside surface of the cylindrical shell to form a seal;

the sealing strip comprising a composite blend of about 100 parts nitrile rubber, about 50–100 parts carbon black, about 150–200 parts graphite, and about 1–20 parts silicone oil or a combination of about 5–20 parts silicone oil and about 10–75 parts polytetrafluoroethylene, which provides the contact edge of the sealing strip with a surface having a low coefficient of friction of about 0.02–0.06 as the contact edge moves along the inside surface of the rotating cylindrical shell.

* * * * *